3/6/84 XR 4,435,714

United States Patent [19]

Luh

[11] 4,435,714

[45] Mar. 6, 1984

[54] GRATING LOBE ELIMINATOR

[75] Inventor: Howard H. Luh, Sunnyvale, Calif.

[73] Assignee: Ford Aerospace & Communications Corp., Dearborn, Mich.

[21] Appl. No.: 220,633

[22] Filed: Dec. 29, 1980

[51] Int. Cl.[3] ..... H01Q 15/02; H01Q 19/19

[52] U.S. Cl. ..... 343/753; 343/756; 343/781 P

[58] Field of Search ..... 343/753, 909, 756, 781 P

[56] References Cited

U.S. PATENT DOCUMENTS

| | | | |
|---|---|---|---|
| 3,261,020 | 7/1966 | Kay | 343/756 |
| 3,641,577 | 2/1972 | Tocquec | 343/754 |
| 3,771,160 | 11/1973 | Laverick | 343/756 |
| 3,797,020 | 3/1974 | Roger et al. | 343/756 |
| 4,031,538 | 6/1977 | Lundgren, Jr. | 343/781 |
| 4,034,378 | 7/1977 | Ohm | 343/781 |
| 4,070,678 | 1/1978 | Smedes | 343/754 |
| 4,096,483 | 6/1978 | Bui Hai et al. | 343/781 CA |
| 4,109,253 | 8/1978 | Chu | 343/756 |
| 4,119,932 | 10/1978 | Bockrath | 333/21 A |
| 4,144,535 | 3/1979 | Dragone | 343/756 |
| 4,212,014 | 7/1980 | Cherroun | 343/909 |
| 4,259,674 | 3/1981 | Dragone et al. | 343/753 |
| 4,284,991 | 8/1981 | Dupressoir . | |

FOREIGN PATENT DOCUMENTS 1512718 1/1978 United Kingdom .

OTHER PUBLICATIONS

Dragone & Gans "Imagine Reflector Arrangement to Form a Scanning Beam using a Small Array, The Bell System Technical Journal, vol. 58, No. 2, Feb. 1979.

Dragone & Gans–Sattellite Phased Arrays: Use of Imaging Reflectors with Spatial Filtering in the Focal Plane to Reduce Grating Lobes.

*Primary Examiner*—Eli Lieberman

*Attorney, Agent, or Firm*—Peter Abolins; Clifford L. Sadler

[57] ABSTRACT

A confocal parabolic antenna system includes a grid of parallel metallic strips placed in the focal plane of the antenna system. The strips are oriented in the direction of an uplink wave polarization and eliminate the grating lobes at the uplink frequency band by reflecting the energy of the particular spatial harmonic components which give rise to the grating lobes.

6 Claims, 12 Drawing Figures

FOR VERTICALLY POLARIZED WAVE

FOR HORIZONTAL POLARIZED WAVE

GRATING LOBE ELIMINATOR

BACKGROUND OF THE INVENTION

1. Field of the Invention

The present invention relates to a method and apparatus for improving the radiating pattern of a parabolic antenna and, more particularly, to eliminating the grating lobes of a confocal parabolic antenna system.

2. Prior Art

A known confocal parabolic antenna system is shown in FIGS. 1*a*, 1*b* and 1*c*. Such an antenna has been proposed by Dragone and Gans for a satellite communication system as described in "Imaging Reflector Arrangement To Form A Scanning Beam Using A Small Array", The Bell System Technical Journal, Vol. 58, No. 2, Feb. 1979. To utilize the reflector efficiently, it has been proposed to operate the antenna at both uplink (ground to satellite) and downlink (satellite to ground) frequency bands through the use of orthogonally polarized feed elements. Since the uplink frequency is considerably higher than the downlink frequency, the antenna will have grating lobes at the uplink frequency. It would be desirable to develop a technique which can reduce the grating lobes of such an antenna system. These are some of the problems this invention overcomes.

Dragone and Gans have continued their work described in "Satellite Phase Arrays: Use of Imagining Reflectors With Spacial Filtering In The Focal Plane To Reduce Grating Lobes", The Bell System Technical Journal, Vol. 59, No. 3, March, 1980. A filter, placed in the focal plane of the main reflector, eliminates undesirable field components due to the grating lobes of the small array. Because of the filter, the illumination over the main aperture is a smoothed version of the array illumination. Thus, grating lobes are reduced. By adjusting the excitation of the various antenna array elements, an antenna with low side lobes is obtained. However, the paper does not disclose the construction of a filter to accomplish any reduction of grating lobes.

Referring to FIGS. 5 through 9 of this article, it is shown that the teaching of the article is to reduce the grating lobes at both the uplink (14.25 GHz) and the downlink (11.8 GHz) frequencies. The reduction of the grating lobes at the downlink frequency is not controllable. It is the by-product of the reduction of the grating lobes at the uplink frequency with the expense of gain reduction at the downlink frequency. This is significant because if reduction of the gain is acceptable, the use of a filter is not necessary. A simpler, less expensive and lighter solution would then be to reduce the size of the subreflector illustrated in FIG. 1 of the publication. In practice, the reduction of the gain at the downlink frequency is more serious than the presence of the grating lobes at the downlink frequency since the grating lobes at the downlink frequency are located at greater angles from the main beam than the grating lobes at the uplink frequency. Thus, the important issue is to reduce the grating lobes at the uplink frequency without affecting the performance of the antenna at the downlink frequency. In the referenced article, there is no teaching as to how to reduce the grating lobes at one frequency without affecting the antenna performance at other frequency.

Further, the prior art teaches various ways of altering antenna radiation patterns. For example, a metallic grid will reflect the component of the electromagnetic wave parallel to the grid and will transmit the component of the electromagnetic wave perpendicular to the grid. The following patents use such a grid to eliminate the cross polarization content of a reflector antenna: U.S. Pat. Nos. 4,144,535 issued to Dragone; 4,119,932 issued to Bockrath and 4,109,253 issued to Chu.

A metallic grid placed in front of a metallic plate will not only reflect the incident electromagnetic wave, but also twist the polarization vector of the wave. Such a property is well known and is taught in the U.S. Pat. to Rogers, No. 3,797,020. U.S. Pat. No. 4,070,678 issued to Smedes utilizes such a device to provide a wide angle scanning antenna.

Metallic grids can also be used to control the direction of the main beam of the antenna thus controlling the direction of main energy flow. Such a configuration is taught in U.S. Pat. No. 3,797,020 to Roger; 3,771,160 to Laverick and 3,261,020 to Kay. Nevertheless, none of these patents teach eliminating or blocking the energy radiating into the direction of the grating lobes but are directed to changing the direction of the main energy beam.

SUMMARY OF THE INVENTION

This invention relates a confocal parabolic antenna system including a conducting grid to eliminate the grating lobes of the antenna radiation pattern. A grid of parallel conducting strips is placed in the focal plane of the antenna system. The strips are oriented in the direction of the uplink wave polarization thereby eliminating the grating lobes at the uplink frequency band by reflecting the energy of the particular spatial harmonic components which gives rise to the grating lobes. Eliminating grating lobes is desirable because it improves the performance of confocal parabolic reflector antennas.

In accordance with an embodiment of this invention, there is a reduction or elimination of the grating lobes at an uplink frequency without affecting the antenna radiation pattern at the downlink frequency. A grating lobe eliminator in accordance with an embodiment of this invention is a simple solution to the problem. Thus, there is taught an apparatus for reducing the grating lobes at 14 GHz without affecting the antenna performance at 12 GHz.

DETAILED DESCRIPTION OF THE INVENTION

Figure 1A:
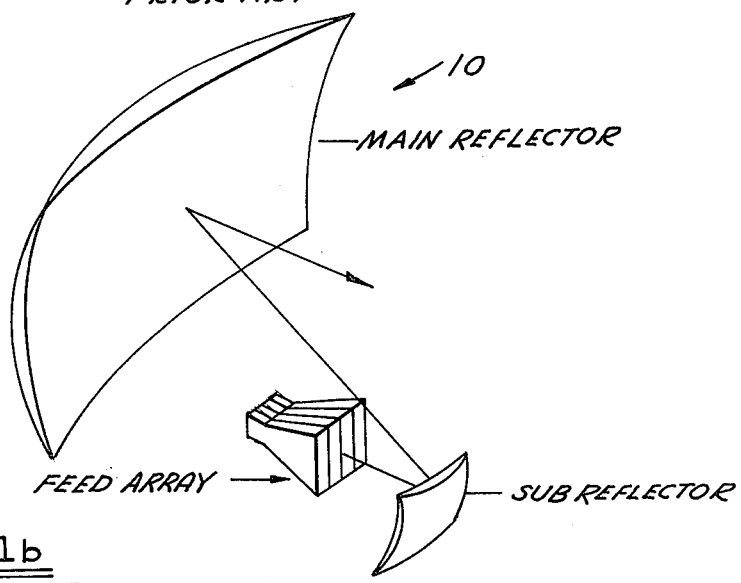
FIG. 1a PRIOR ART
FIGS. 1*a*, 1*b* and 1*c* show a prior art confocal parabolic antenna system in perspective, side view, and top view, respectively.
Figure 1B:
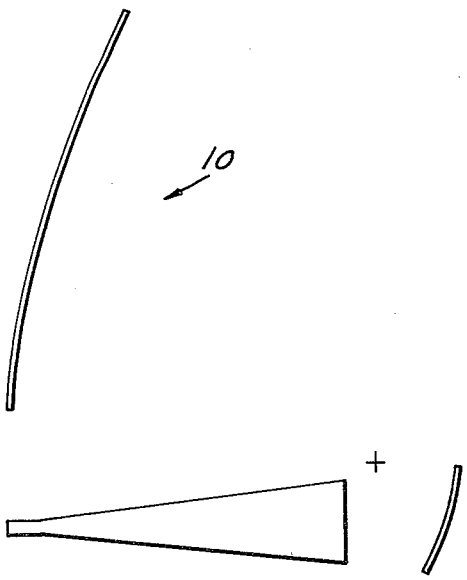
FIG. 1b PRIOR ART
Figure 1C:
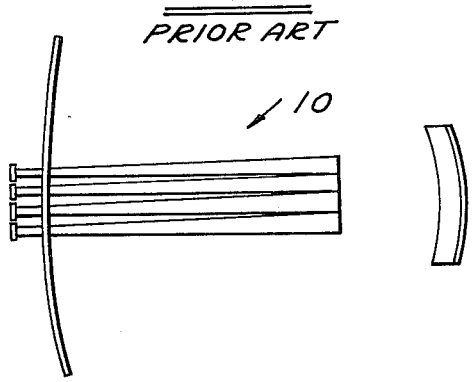
FIG. 1c PRIOR ART
Figure 2A:
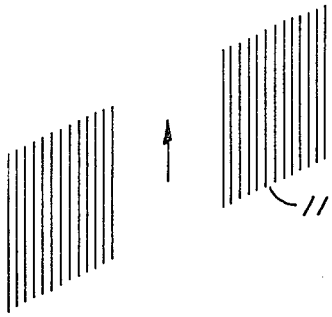
FIGS. 2*a* and 2*b* are illustrations of metallic strip grids for use with a vertically polarized wave providing one dimensional control and a horizontal polarized wave providing two dimensional control respectively.
Figure 2B:
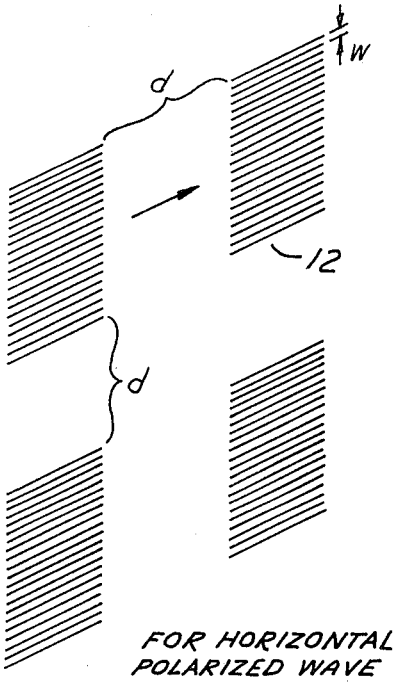
Figure 3A:
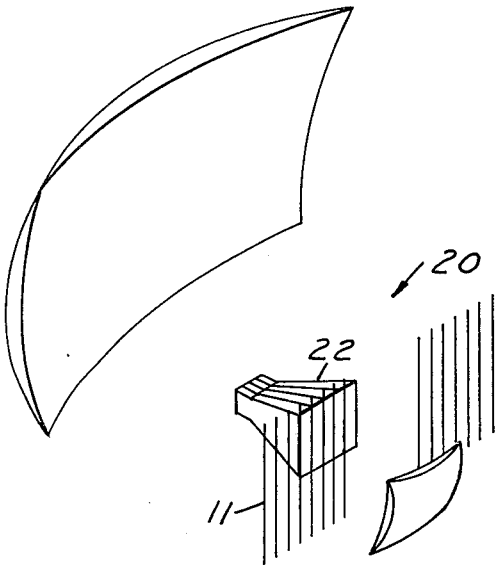
FIGS. 3*a* and 3*b* are a perspective view and a side view, respectively, of a confocal parabolic antenna system in accordance with an embodiment of this invention including the grating lobe eliminators in the focal plane.
Figure 3B:
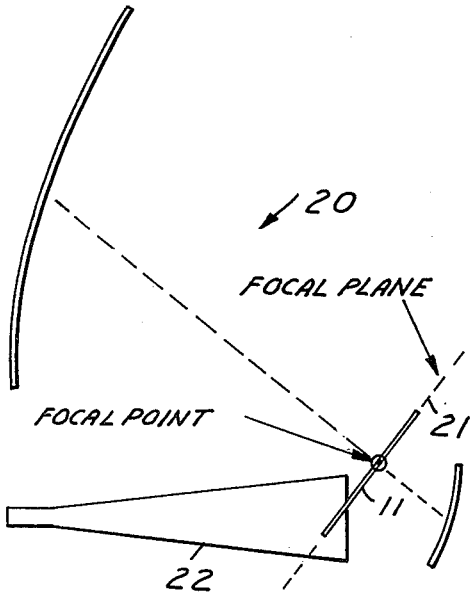

A prior art antenna system 10 (FIG. 1*a*) can include either vertical metallic strips 11 (FIG. 2*a*) or horizontal metallic strips 12 (FIG. 2*b*) to produce an antenna system 20 shown in FIG. 3*a* in accordance with an embodiment of this invention. The grid of parallel metallic strips shown in FIG. 2*a* is placed in the focal plane 21 of the reflector antenna system 20 shown in FIG. 3*b*. The metallic strips 11 are oriented in the direction of the uplink wave polarization.

Figure 4:
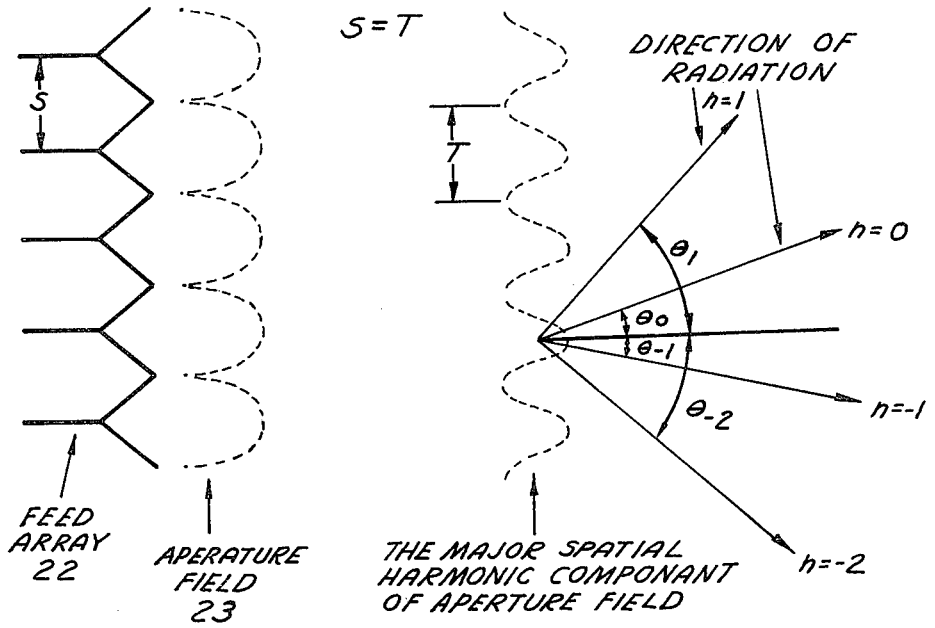
FIG. 4 is a generally plan schematic view of a feed array and an antenna pattern emanating from the array.

Due to the equal spacing of the feed elements 22, the feed array aperture field 23 contains very strong spatial harmonic components (FIG. 4). The period of this harmonic component, T, is identical to the feed array element spacing, S. It is this spatial harmonic which generates the grating lobes in the antenna pattern. By preventing this harmonic from radiating into space, the grating lobes disappear. The spatial harmonic of the period T will radiate strongly in the direction given by:

$$\theta_n = \mathrm{Sin}^{-1}\left(\frac{(2n+1)\lambda_o}{T}\right) \quad (1)$$

$$n = 0, \pm 1, \pm 2 \ldots$$

Figure 5:
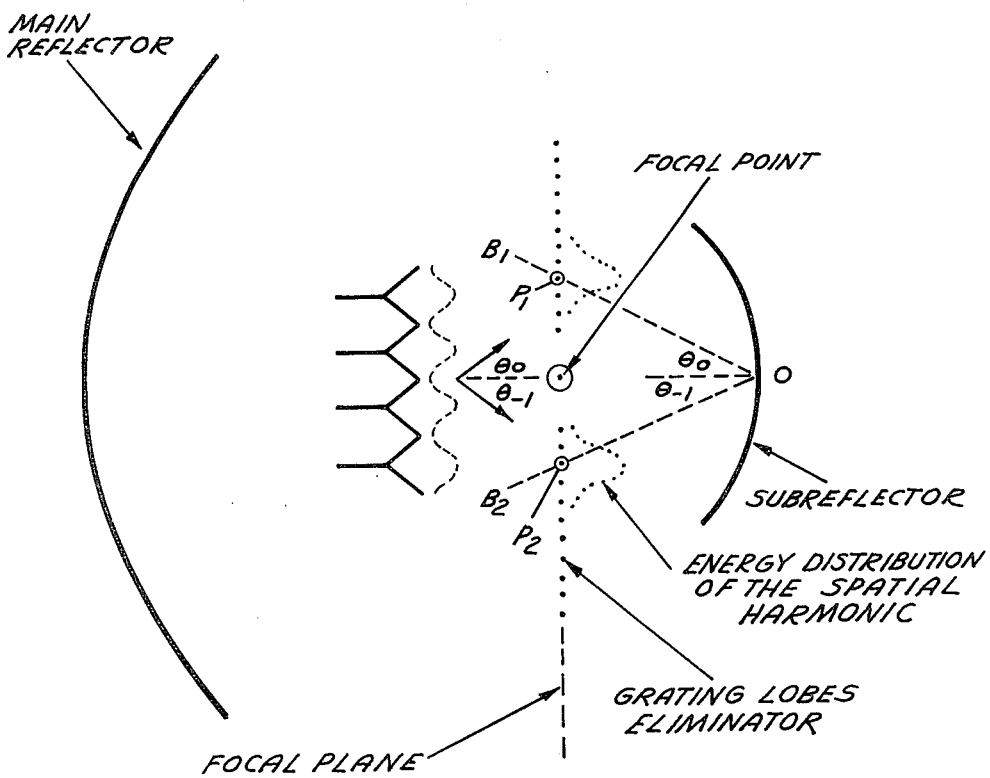
FIG. 5 is a view similar to FIG. 4 also showing the main reflector and subreflector and with the inclusion of the grating lobe eliminators in accordance with an embodiment of this invention.

This energy is distributed all over space except on the focal plane of the reflector where the energy is concentrated in the neighborhood of the discrete points $P_1$, $P_2$, etc. (FIG. 5) where $P_1$, $P_2$ are the intersection of line $OB_1$, $OB_2$... with the focal plane. If one places metallic strips at $P_1$, $P_2$, etc., the energy of this particular spatial harmonic will be reflected by the metallic strip. Thus, the energy will not radiate into the grating lobes direction and there will be no grating lobes.

The presence of the device will not affect the orthogonally polarized downlink performance since the metallic strip is perpendicular to the polarization of the downlink electromagnetic waves. Thus, by attaching a grid of conducting strips on confocal parabolic reflector system in accordance with an embodiment of this invention, one can eliminate the grating lobes at the uplink frequency band without disturbing the antenna performance at the downlink frequency.

Figure 6:
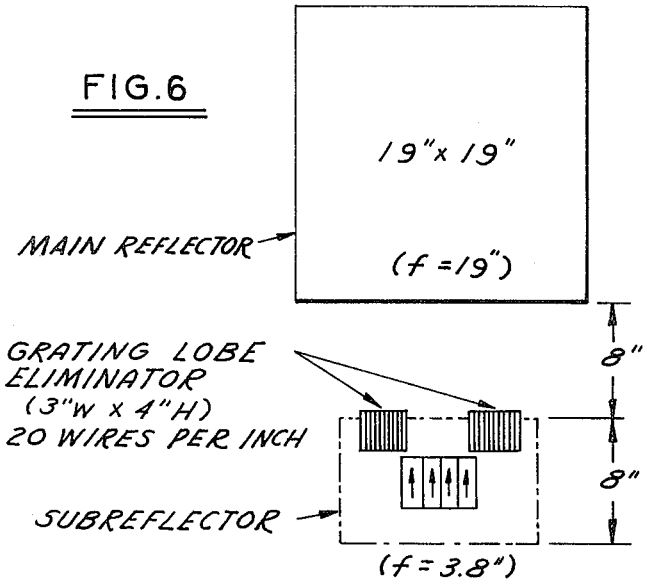
FIG. 6 is a front view, of an experimental confocal parabolic antenna system in accordance with an embodiment of this invention.
Figure 7:
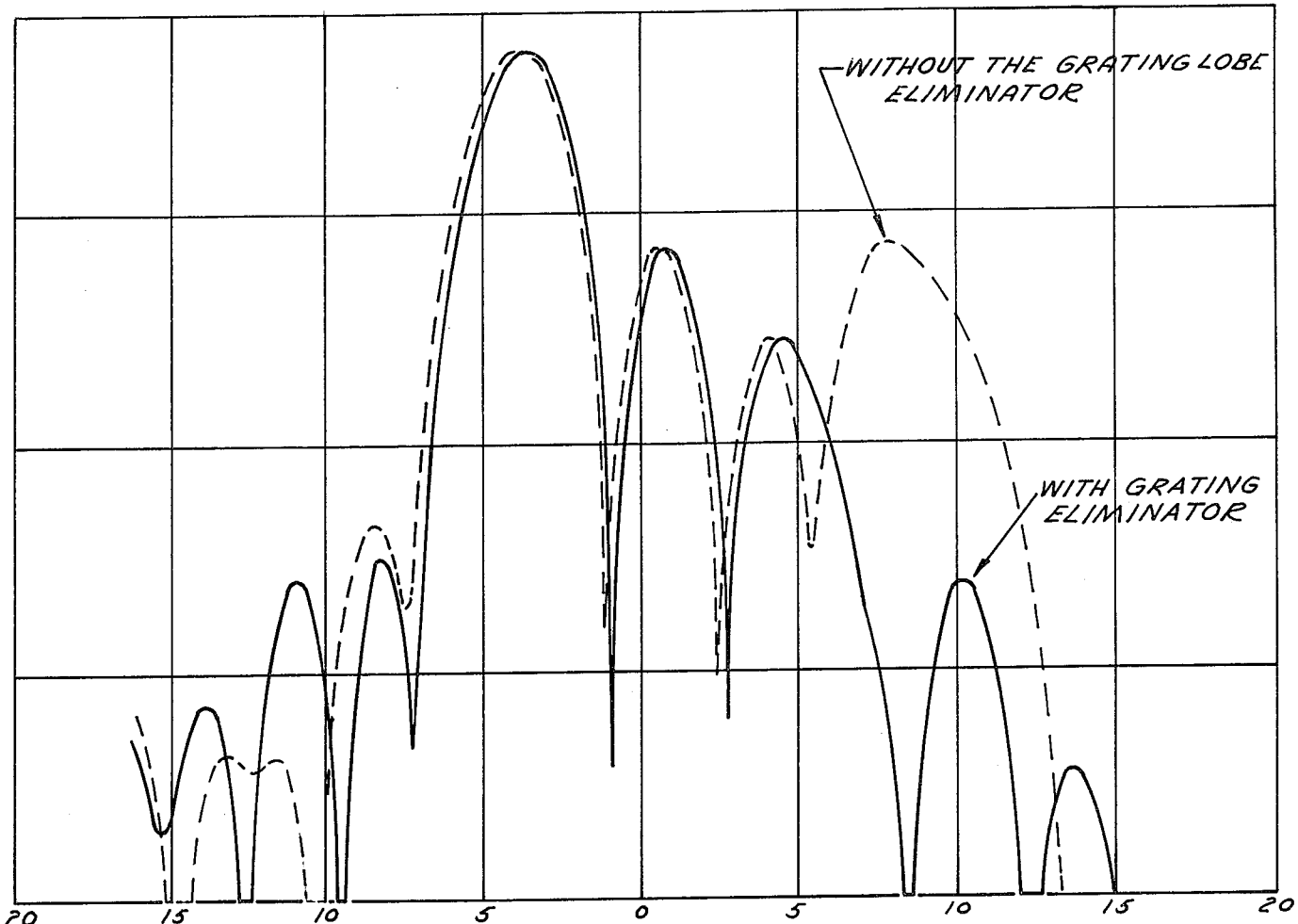
FIG. 7 is a radiating pattern of the confocal system shown in FIGS. 6*a* and 6*b* with and without the use of the grating lobe eliminator.

FIG. 6 shows an experimental confocal system in accordance with an embodiment of this invention. The radiation patterns of the confocal reflector antenna system of FIG. 6 is shown in FIG. 7 with and without the use of a grating lobe eliminator. The improvement at an angle of about 8° can readily be appreciated.

Figure 8:
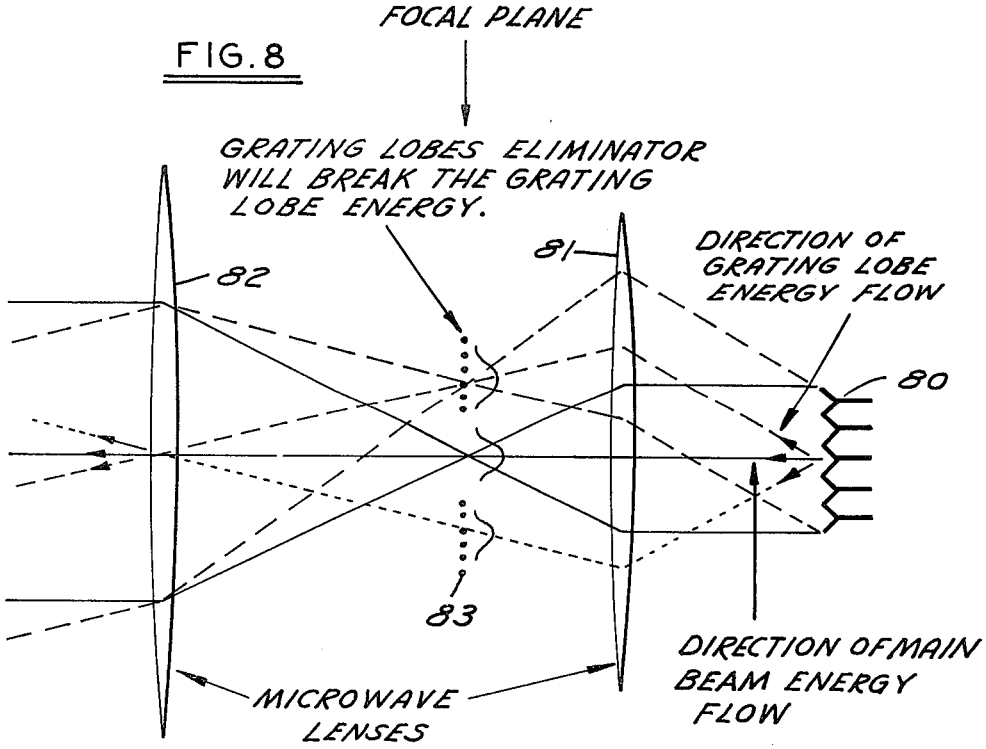
FIG. 8 is a side view of a grating lobe eliminator used with a microwave lens system in accordance with an embodiment of this invention.

A grating lobe eliminator in accordance with an embodiment of this invention can also be used with microwave lenses instead of reflectors as shown in FIG. 8. Energy from a radiating array is passed through a first microwave lens 81 and then through a second microwave lens 82. At the focal point between the two microwave lenses is positioned a grating lobe eliminator 83 in accordance with an embodiment of this invention, typically including a plurality of conducting wires.

Referring to FIG. 2*b*, a conducting grid suitable for use in two dimensions is shown having four sections of conducting grids spaced from each other along two orthoganal directions. Such an arrangement is particularly advantageous when radiation is to be controlled in two orthoganal directions in the antenna system. A typical spacing, W, between adjacent conducting strips is greater than zero and less than one-tenth of the wavelength of the transmitted energy. Further, the length of each of the conducting strips is advantageously longer than one-half of the wavelength of the radiated energy. One way of fabricating a grid can be by forming a printed circuit. Thus, there are conducting strips formed on an electromagnetically transparent material such as an insulating board supporting the printed circuit. The spacing, d, as shown in FIG. 2*b* between adjacent conducting grid sections is sufficiently wide and positioned so that a substantial portion of energy radiated from the subreflector to the reflector can pass through the separation.

Various modifications and variations will no doubt occur to those skilled in the various art to which this invention pertains. For example, the particular radiating feed horn for the antenna system may be varied from that disclosed herein. These and all other variations which basically rely on the teachings through which this invention has advanced the art are properly considered within the scope of this invention.

I claim:

1. An antenna system for radiating energy having a radiating array, a secondary energy convergence aperture means, and a main energy convergence aperture means, said antenna system including:

orthogonally linearly polarized feed elements;

a grid of parallel conducting strips placed in the focal plane of said antenna system, said strips being oriented in the direction of the uplink wave polarization thereby eliminating the grating lobes at the uplink frequency band by reflecting the energy of the particular spatial harmonic components which give rise to the grating lobes;

said grid of conducting strips being positioned between said secondary energy convergence aperture means and said main convergence aperture means, and the spacing between adjacent parallel conducting strips being greater than zero and less than one-tenth of the wavelength of the radiated energy; and said grid of parallel conducting strips having a first segment and a second segment spaced from one another by an opening and centered about said main energy convergence aperture means so that a substantial portion of the beam from said secondary energy convergence aperture means to said main energy convergence aperture means can pass through said opening between said first and second segments.

2. An antenna system as recited in claim 1 wherein said grid of parallel conducting strips extends to the sides so that the grating lobes of the radiated pattern substantially strike only said grid, the length of the parallel conducting strips being greater than one-half the wave length of the radiated field.

3. An antenna system as recited in claim 2 wherein said grid of parallel conducting strips is a printed circuit of conducting material formed on an electric magnetically transparent material.

4. An antenna system as recited in claim 3 wherein said antenna system is adapted to radiate in two dimensions, said first and second segments of said grid are spaced from each other in a first direction and a third section is spaced from said first section in a second direction, orthogonal to said first direction, the conducting strips in said first, second and third sections being parallel to one another.

5. An antenna system as recited in claim 4 wherein said antenna system is a confocal parabolic antenna system, said secondary energy convergence aperture means is a subreflector, and said main energy convergence aperture means is a main reflector.

6. An antenna system as recited in claim 4 wherein said antenna system is a microwave antenna system, said secondary energy convergence aperture means is a secondary microwave lens, and said main energy convergence aperture means is a main microwave lens.

* * * * *